US007216611B2

(12) United States Patent
Matsutani et al.

(10) Patent No.: US 7,216,611 B2
(45) Date of Patent: May 15, 2007

(54) COOLING STRUCTURE OF CYLINDER BLOCK

(75) Inventors: Takashi Matsutani, Toyota (JP); Takanori Nakada, Toyota (JP); Yoshikazu Shinpo, Nisshin (JP); Makoto Hatano, Obu (JP); Takashi Kubota, Obu (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 11/067,655

(22) Filed: Feb. 28, 2005

(65) Prior Publication Data

US 2005/0199195 A1 Sep. 15, 2005

(30) Foreign Application Priority Data

Mar. 10, 2004 (JP) ..... 2004-067871

(51) Int. Cl.
*F02F 1/10* (2006.01)

(52) U.S. Cl. ..... 123/41.72; 123/198 E; 123/41.15; 123/41.81

(58) Field of Classification Search ..... 123/41.72, 123/41.15, 41.74, 41.79, 41.81, 41.83, 198 D
See application file for complete search history.

(56) References Cited

U.S. PATENT DOCUMENTS

| | | | | |
|---|---|---|---|---|
| 4,782,891 | A | 11/1988 | Cheadle et al. | |
| 5,188,071 | A | 2/1993 | Han | |
| 6,581,550 | B2 * | 6/2003 | Shinpo et al. | 123/41.74 |
| 6,883,471 | B1 | 4/2005 | Belter et al. | |

FOREIGN PATENT DOCUMENTS

| | | |
|---|---|---|
| DE | 1220 203 | 6/1966 |
| DE | 27 56 120 A1 | 6/1979 |
| DE | 3741838 A1 | 6/1988 |
| DE | 198 40 379 C2 | 3/2000 |
| DE | 696 103 58 T | 4/2001 |
| DE | 696 22 883 T1 | 4/2003 |
| DE | 103 25 753 A1 | 6/2003 |
| DE | 103 25 874 A1 | 6/2003 |
| EP | 1 167 735 A2 | 1/2002 |
| JP | U-04-119330 | 10/1992 |
| JP | Y2-2604041 | 2/2000 |
| JP | (A) 2002-030989 | 1/2002 |
| JP | A-2002-030989 | 1/2002 |

OTHER PUBLICATIONS

German Office Action for German Patent Application No. 10 2005 009 054.0.

* cited by examiner

*Primary Examiner*—Stephen K. Cronin
*Assistant Examiner*—Katrina Harris
(74) *Attorney, Agent, or Firm*—Kenyon & Kenyon LLP

(57) ABSTRACT

A cooling structure of a cylinder block includes a water jacket portion which is provided so as to surround an entire outer periphery of the bore wall; a water jacket spacer which is inserted in the water jacket portion; and a gasket which is provided in an upper portion of the cylinder block, and which includes a hole leading to the water jacket portion. The water jacket portion is supplied with coolant. A distance between a center of the hole and an outer periphery of the cylinder block is shorter than a distance between a center of the water jacket spacer in a thickness direction and the outer periphery of the cylinder block. In the cooling structure, the cylinder block can be uniformly cooled.

6 Claims, 10 Drawing Sheets

COOLING STRUCTURE OF CYLINDER BLOCK

The disclosure of Japanese Patent Application No. 2004-067871 filed on Mar. 10, 2004, including the specification, drawings and abstract is incorporated herein by reference in its entirety.

BACKGROUND OF THE INVENTION

1. Field of the Invention

The invention relates to a cooling structure of a cylinder block, and more particularly to a cooling structure of a cylinder block which makes it possible to uniformly cool a bore wall of the cylinder block.

2. Description of the Related Art

A conventional cooling structure of a cylinder block is disclosed, for example, in Japanese Patent Laid-Open Publication No. 2002-30989.

The Japanese Patent Laid-Open Publication No. 2002-30989 discloses a technology in which the temperature of a bore wall is made uniform by providing a water jacket spacer inside a water jacket of a cylinder block of an internal combustion engine. However, the bore wall is overcooled in the vicinity of a coolant hole of a head gasket, and in the vicinity of portions connected to bypass pipes (e.g., an oil cooler, an automatic transmission fluid cooler, and a turbo cooler). This is because a flow speed of coolant in an inner wall of the water jacket becomes high in the vicinity of the coolant hole and in the vicinity of the portions connected to the pipes through which the coolant flows in and flows out of the cylinder block.

Accordingly, in the conventional cooling structure of a cylinder block, it is difficult to uniformly cool the bore wall.

SUMMARY OF THE INVENTION

In view of the above, it is an object of the invention to provide a cooling structure of a cylinder block which makes it possible to uniformly cool the cylinder block.

An aspect of the invention relates to a cooling structure of a cylinder block, in which a temperature of a bore wall is made uniform using a cooling medium. The cooling structure of a cylinder block includes a water jacket portion which is provided so as to surround an entire outer periphery of the bore wall and which is supplied with the cooling medium; a water jacket spacer which is inserted in the water jacket portion; and a gasket which is provided in an upper portion of the cylinder block, and which includes a hole leading to the water jacket portion. In the cooling structure of a cylinder block, a distance between a center of the hole and an outer periphery of the cylinder block is shorter than a distance between a center of the water jacket spacer in a thickness direction and the outer periphery of the cylinder block.

In the aforementioned cooling structure of a cylinder block, the distance between the center of the hole (coolant hole) formed in the gasket and the outer periphery of the cylinder block is shorter than the distance between the center of the water jacket spacer in the thickness direction and the outer periphery of the cylinder block. Therefore, for example, when the cooling medium flows from an engine head portion into the water jacket portion of the cylinder block through the hole of the gasket, the cooling medium flows into a space between the water jacket spacer and a side opposite to the bore wall. Thus, this cooling structure is effective for preventing overcooling of the bore wall. Accordingly, the cylinder block can be uniformly cooled.

Another aspect of the invention relates to a cooling structure of a cylinder block, in which a temperature of a bore wall is made uniform using a cooling medium. The cooling structure of a cylinder block includes a water jacket portion which is provided so as to surround an entire outer periphery of the bore wall and which is supplied with the cooling medium; a water jacket spacer which is inserted in the water jacket portion; a bypass passage which is provided in the cylinder block, and which connects the water jacket portion to equipment; and a flow rate control mechanism which is provided in the vicinity of the bypass passage, and which reduces a flow rate of the cooling medium in a space between the water jacket spacer and the bore wall.

In the aforementioned cooling structure of a cylinder block, since the flow rate control mechanism is provided in the vicinity of the bypass passage, it is possible to reduce the flow rate of the cooling medium flowing along a surface of the water jacket portion on the bore wall side. As a result, the bore wall can be prevented from being overcooled, and the cylinder block can be uniformly cooled.

BRIEF DESCRIPTION OF THE DRAWINGS

The above mentioned and other objects, features, advantages, technical and industrial significance of this invention will be better understood by reading the following detailed description of exemplary embodiments of the invention, when considered in connection with the accompanying drawings, in which.

DETAILED DESCRIPTION OF THE PREFERRED EMBODIMENTS

Figure 1:
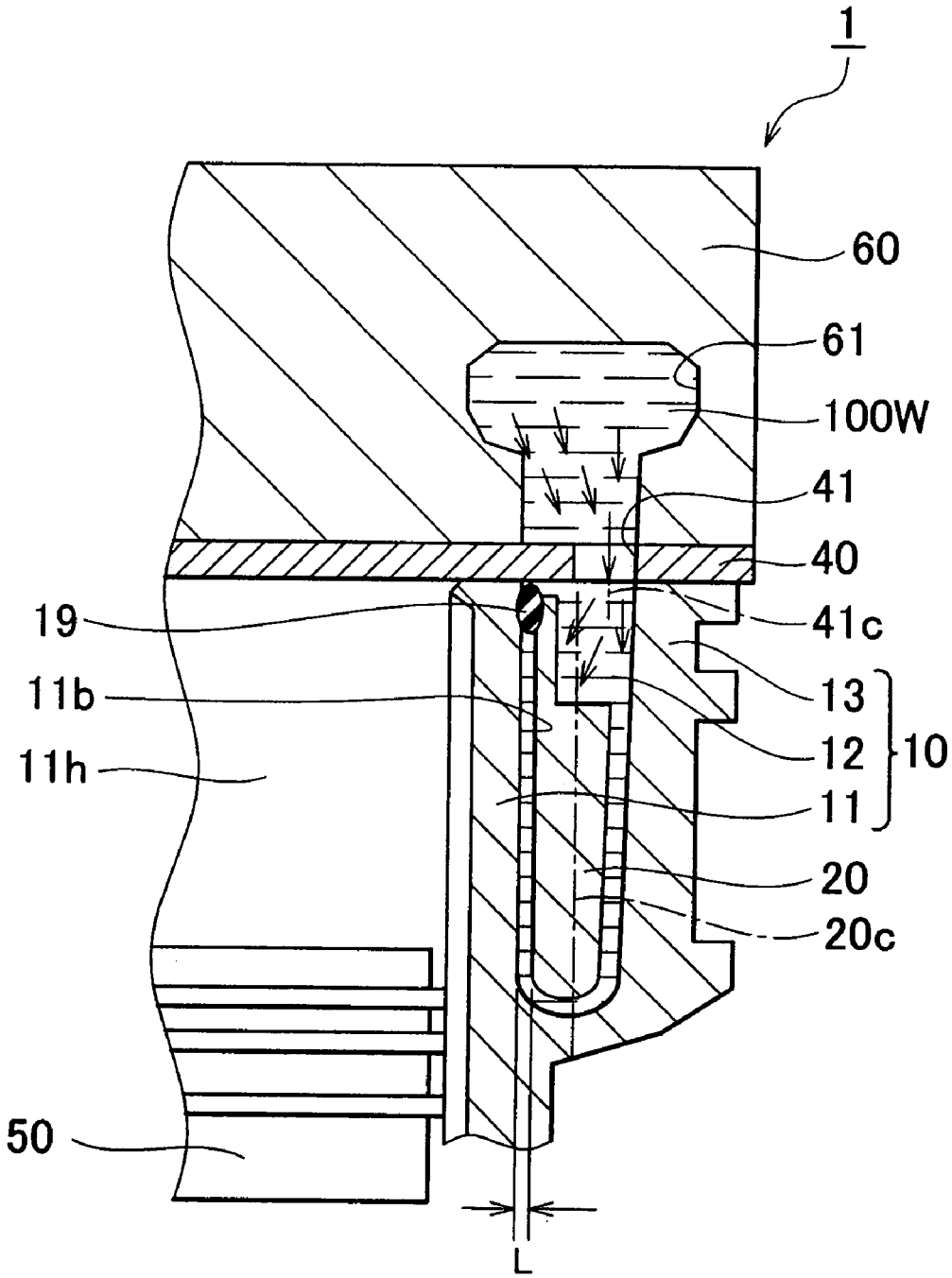
FIG. 1 is a cross sectional view showing a cooling structure of a cylinder block according to a first embodiment of the invention.

In the following description and the accompanying drawings, the present invention will be described in more detail with reference to exemplary embodiments.

Hereinafter, exemplary embodiments of the invention will be described with reference to the accompanying drawings. In the embodiments, the same portions or equivalent portions are denoted by the same reference numerals, and duplicate description thereof will be omitted.

FIG. 1 is a cross sectional view showing a cooling structure of a cylinder block according to a first embodiment of the invention. As shown in FIG. 1, a cooling structure 1 of a cylinder block according to the first embodiment includes a cylinder block 10 including a water jacket portion 12 that is provided so as to surround an entire outer periphery of a bore wall 11*b*; a water jacket spacer 20 which is inserted in the water jacket portion 12; and a gasket 40 which is provided in an upper portion of the cylinder block 10, and which includes a hole 41 leading to the water jacket portion 12. The water jacket portion 12 is supplied with coolant 100 W that is a cooling medium, whereby the temperature of the bore wall 11*b* is made uniform. A distance between a center 41*c* of the hole 41 and an outer periphery of the cylinder block 10 is shorter than a distance between a center 20*c* of the water jacket spacer 20 in a thickness direction and the outer periphery of the cylinder block 10.

The cylinder block 10 includes a cylinder liner assembly 11 which is provided inside the cylinder block 10; the water jacket portion 12 which is provided so as to surround the cylinder liner assembly 11, and which serves as a cooling medium passage; and a cylinder block base portion 13 which surrounds the water jacket portion 12, and which is opposed to the cylinder liner assembly 11.

The cylinder liner assembly 11 is constituted by a cylinder liner that is made of iron; and aluminum alloy that surrounds the cylinder liner. The cylinder liner assembly 11 includes a bore region 11*h* in which a piston is inserted. The bore region 11*h* is a substantially cylindrical region. Plural bore regions 11*h* are arranged in one direction.

The number of the bore regions 11*h* is not limited to a specific number. The number of the bore regions 11*h* may be variously changed. The cylinder liner assembly 11 includes the bore wall 11*b*. The bore wall 11*b* is cooled by the cooling medium (coolant 100 W) supplied to the water jacket portion 12. Heat generated in the bore region 11*h* is dissipated from the bore wall 11*b* to the outside.

The water jacket portion 12 is provided between the cylinder liner assembly 11 and the cylinder block base portion 13. The water jacket portion 12 serves as a passage through which the coolant 100 W that is the cooling medium flows. The water jacket portion 12 includes a bottom portion. The cylinder liner assembly 11 is connected to the cylinder block base portion 13 at the bottom portion of the water jacket portion 12. The water jacket portion 12 is configured to have a substantially uniform width. That is, a distance between the bore wall 11*b* of the cylinder liner assembly 11 and the cylinder block base portion 13 is substantially uniform.

The cylinder block base portion 13 is made of aluminum alloy, and is formed by die casting or the like. The material used for forming the cylinder liner assembly 11 and the cylinder block base portion 13 is not limited to aluminum alloy. Thus, the cylinder liner assembly 11 and the cylinder block base portion 13 may be made of cast iron. The cylinder block base portion 13 serves as an engine block, and various auxiliary machines that need to be provided in an engine are fitted to the cylinder block base portion 13. A piston 50 is provided in the bore region 11*h*.

Further, as the cooling medium, various fluids such as water, long-life coolant, and oil can be used.

The water jacket spacer 20 is inserted in the water jacket portion 12. The water jacket spacer 20 has a shape similar to a shape of the water jacket portion 12 such that the water jacket spacer 20 can be inserted in the water jacket portion 12. Also, the water jacket spacer 20 is formed so as to surround the cylinder liner assembly 11. The material used for forming the water jacket spacer 20 is not limited to a specific material. That is, as the material used for forming the water jacket spacer 20, it is possible to use various materials, such as aluminum, cast iron, nonmetallic materials, inorganic materials, and organic materials.

Part of an upper portion of the water jacket spacer 20 is cut off. The upper portion of the water jacket spacer 20 is covered with a heat insulation material 19. The heat insulation material 19 is in contact with both of the water jacket spacer 20 and the bore wall 11*b*. That is, a small space having a width L between the water jacket spacer 20 and the bore wall 11*b* is closed by the heat insulation material 19 at one end. Thus, it is possible to suppress the flow of coolant in the small space between the water jacket spacer 20 and the bore wall 11*b*.

A gasket 40 is provided on the cylinder block 10 in order to prevent leakage of the coolant, leakage of lubricating oil, and pressure loss. The gasket 40 may be made of metal. Also, the gasket 40 may be made of an inorganic material. The hole 41 is formed in the gasket 40, and the hole 40 leads to the water jacket portion 12.

An engine head 60 is provided on the gasket 40. Various devices such as cams and valves are fitted to the engine head 60. A head passage 61 for cooling the engine head 60 is provided in the engine head 60. The coolant 100 W that is the cooling medium flows in the head passage 61. Thus, the coolant 100 W can remove heat in the vicinity of the head passage 61.

The hole 41 is formed in the gasket 40 such that the position of the hole 41 is deviated from the position of the space between the water jacket spacer 20 and the bore wall 11*b* when seen from above. That is, the position of the hole 41 does not overlap with the position of the space between the water jacket spacer 20 and the bore wall 11*b* when seen from above. Thus, the flow speed of the coolant is decreased at the bore wall 11*b*.

An upper portion of the water jacket portion 12 is covered with the water jacket spacer 20 and the cylinder block base portion 13 in the vicinity of the hole 41 of the gasket 40. The heat insulation material 19 is attached to the bore wall 11*b*. A protrusion portion may be formed in the water jacket spacer 20 in order to suppress the flow of the coolant in the space between the water jacket spacer 20 and the bore wall 11*b*. The width L of the space between the water jacket spacer 20 and the bore wall 11*b* is made smaller than a width of a space between the water jacket spacer 20 and the cylinder block base portion 13.

Figure 2:
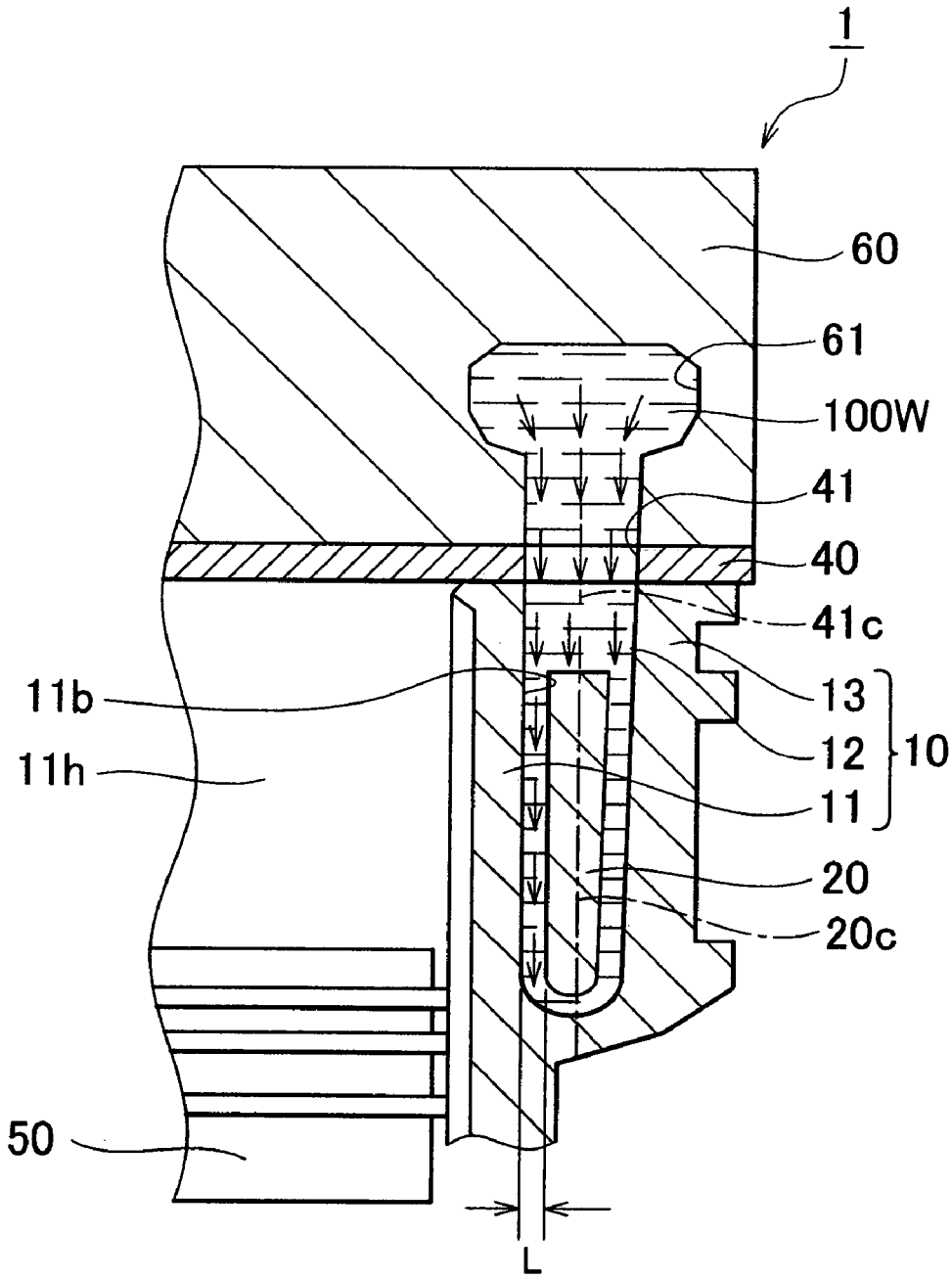
FIG. 2 PRIOR ART
FIG. 2 is a cross sectional view showing a cooling structure of a cylinder block according to a comparative example.

FIG. 2 is a cross sectional view showing a cooling structure of a cylinder block according to a comparative example. As shown in FIG. 2, in the comparative example, the position of the center 41*c* of the hole 41 overlaps with the position of the center 20*c* of the water jacket spacer 20 when seen from above. Thus, the coolant is likely to flow into the space between the bore wall 11*b* and the water jacket spacer 20, and therefore the bore wall 11*b* is overcooled.

In FIG. 1 and FIG. 2, the coolant flows from the engine head 60 toward the cylinder block 10.

Figure 3:
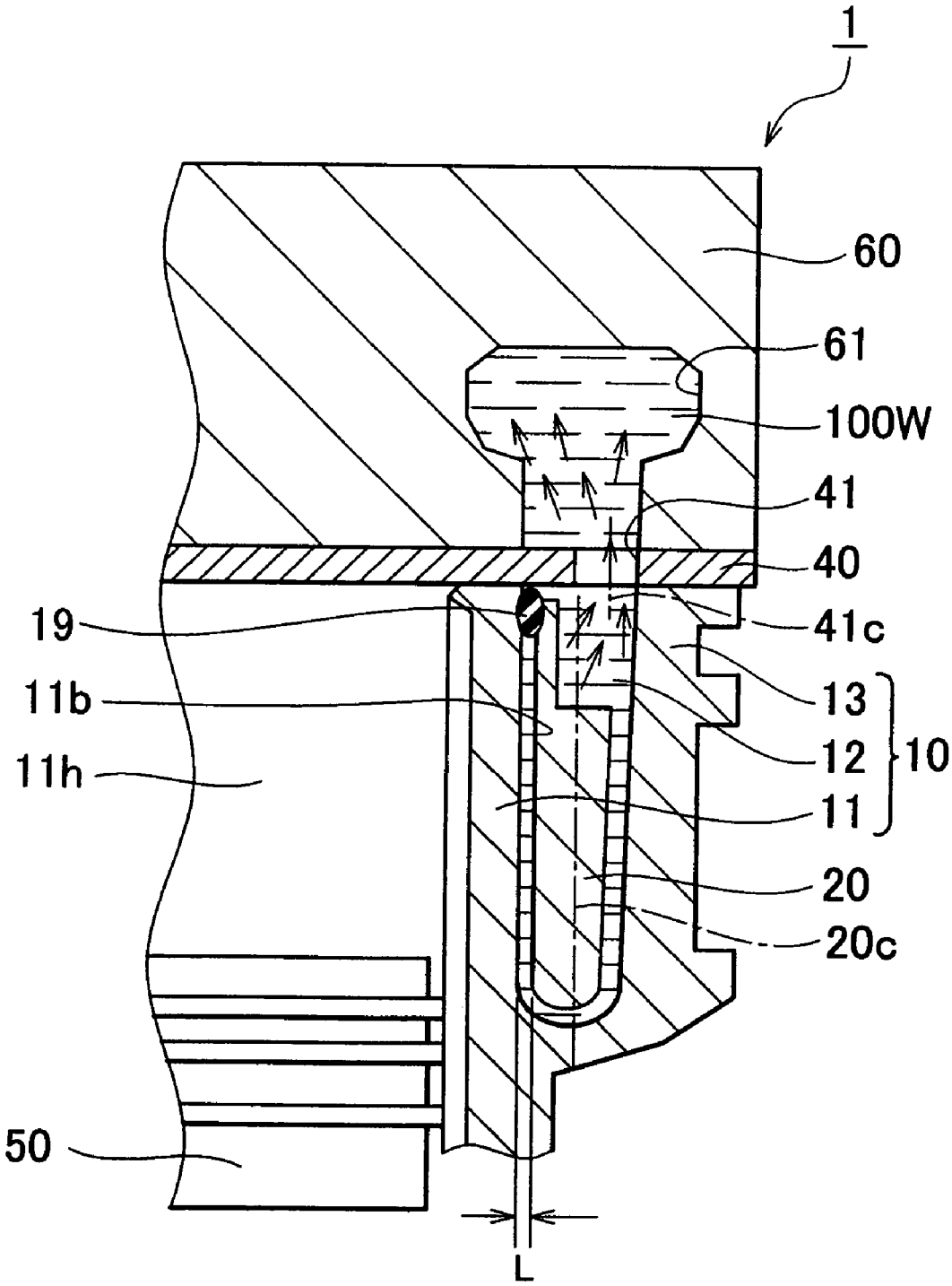
FIG. 3 is a cross sectional view showing the cooling structure of a cylinder block according to the first embodiment of the invention.

FIG. 3 is a cross sectional view showing the cooling structure of a cylinder block according to the first embodi ment of the invention. As shown in FIG. 3, since the hole 41 of the gasket 40 is formed close to the outer periphery of the cylinder block 10, the coolant flows in the outer portion of the water jacket portion 12 as shown by arrows. Thus, it is possible to suppress the flow of the coolant in the space between the water jacket spacer 20 and the bore wall 11*b*. As a result, the bore wall 11*b* can be prevented from being overcooled.

Figure 4:
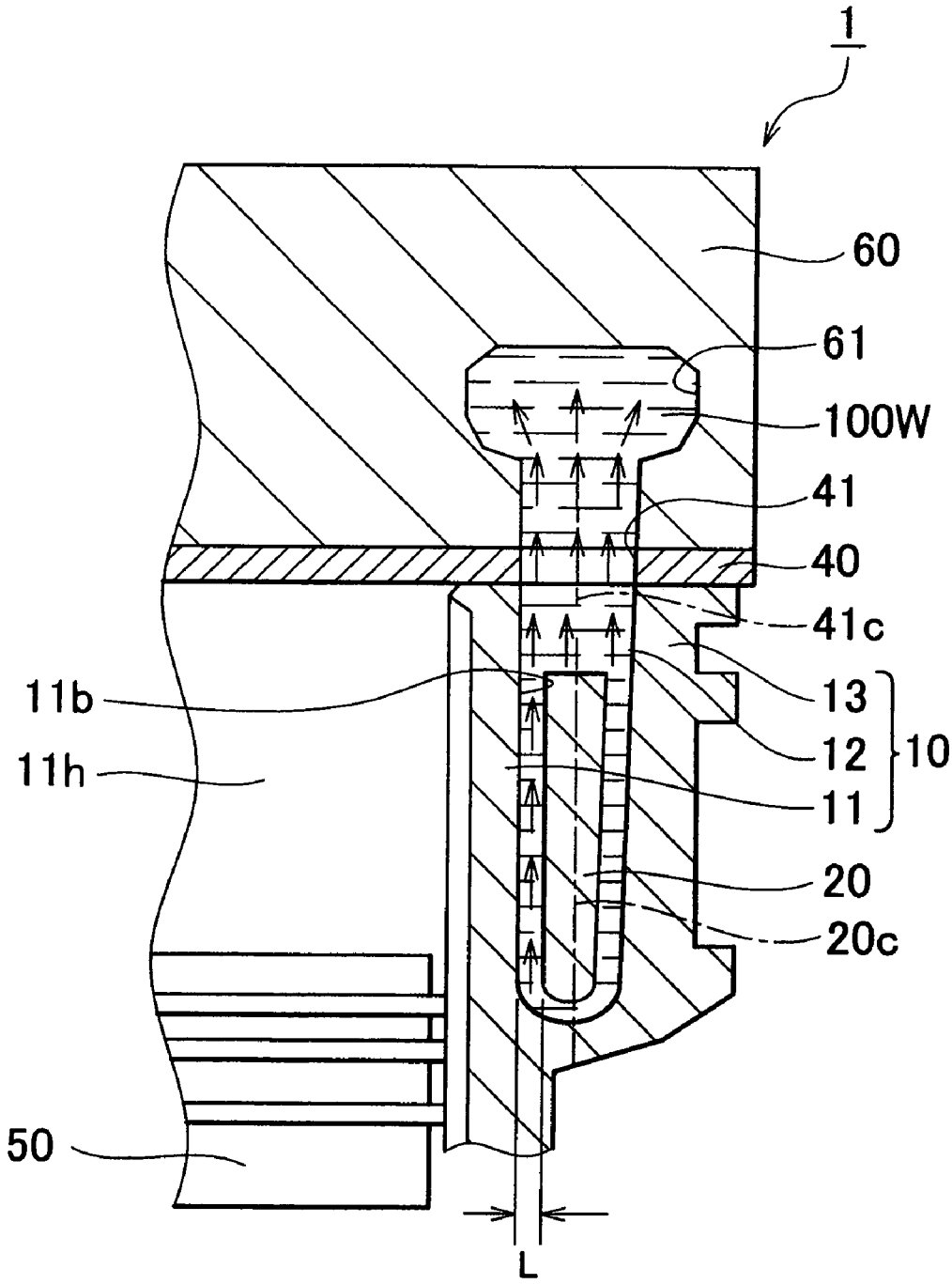
FIG. 4 PRIOR ART
FIG. 4 is a cross sectional view showing the cooling structure of a cylinder block according to the comparative example.

FIG. 4 is a cross sectional view showing the cooling structure of a cylinder block according to the comparative example. As shown in FIG. 4, since the position of the center 41*c* of the hole 41 overlaps with the position of the center 20*c* of the water jacket spacer 20 when seen from above, the coolant is likely to flow into the space between the water jacket spacer 20 and the bore wall 11*b*. Thus, an active flow of the coolant occurs in the space between the bore wall 11*b* and the water jacket spacer 20 as shown by arrows, and the speed of this flow increases. As a result, the bore wall 11*b* opposed to the water jacket spacer 20 is overcooled.

As described above, in the cooling structure of a cylinder block according to the first embodiment of the invention, the bore wall 11*b* can be prevented from being overcooled. As a result, it is possible to prevent overcooling of a specific cylinder. Thus, the cylinder block can be uniformly cooled.

Figure 5:
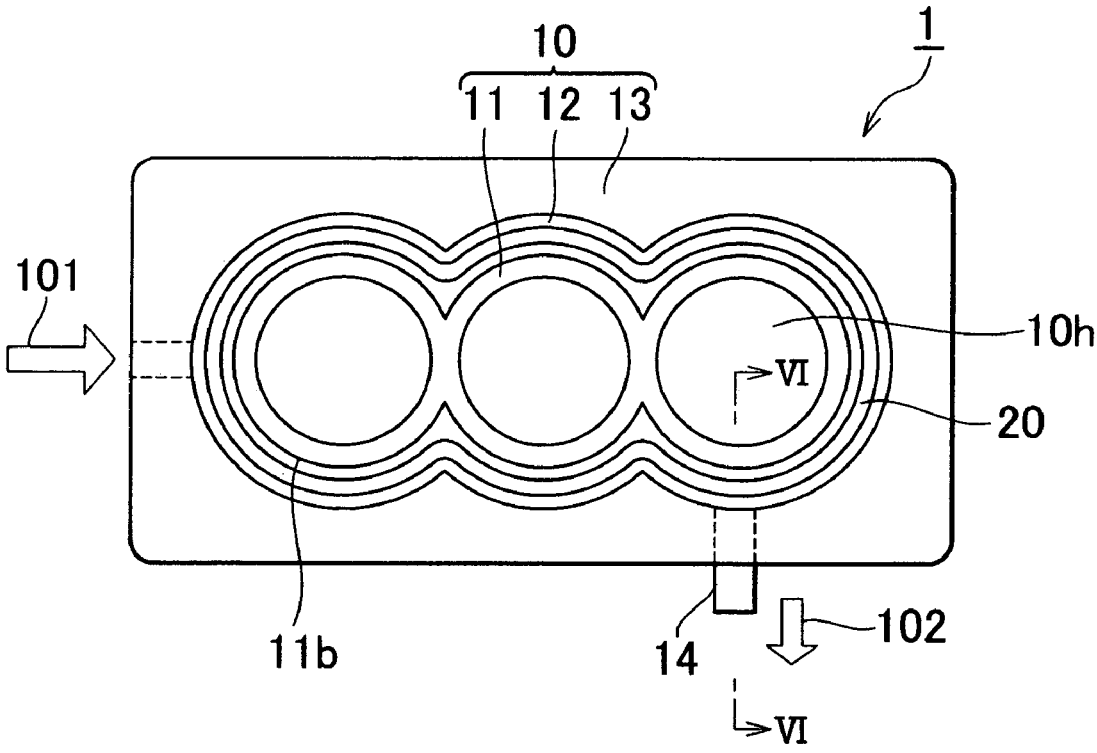
FIG. 5 is a plan view showing a cooling structure of a cylinder block according to a second embodiment of the invention.
Figure 6:
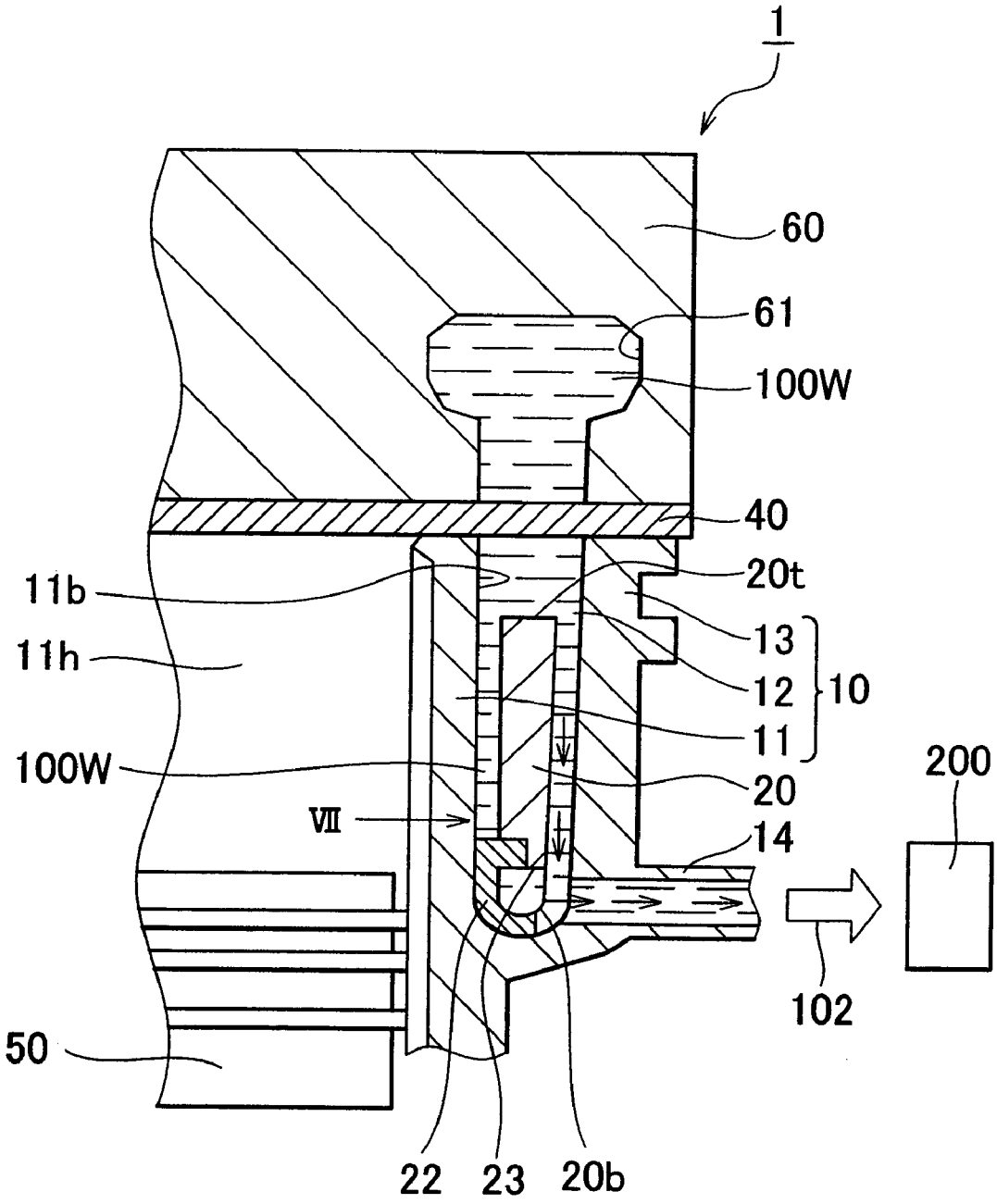
FIG. 6 is a cross sectional view taken along line VI—VI in FIG. 5.
Figure 7:
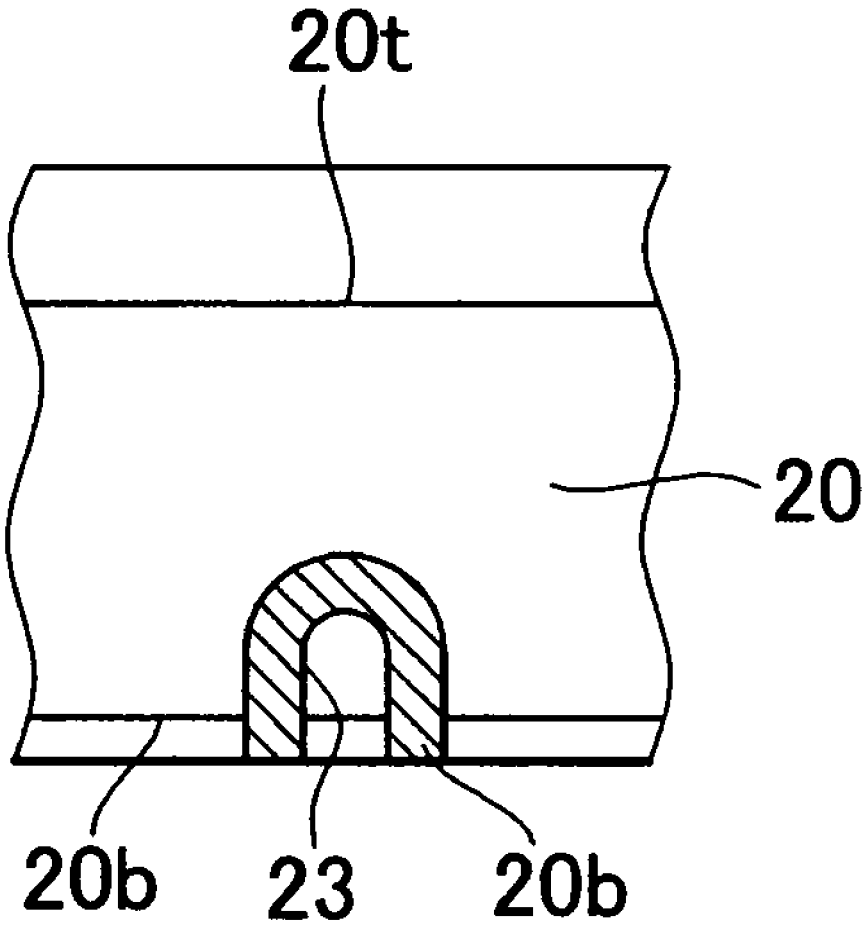
FIG. 7 is a front view showing a water jacket spacer seen in a direction shown by an arrow VII in FIG. 6.

FIG. 5 is a plan view showing a cooling structure of a cylinder block according to a second embodiment of the invention. FIG. 6 is a cross sectional view taken along line VI—VI in FIG. 5. FIG. 7 is a front view showing the water jacket spacer seen in a direction shown by an arrow VII in FIG. 6. As shown in FIG. 5, after the coolant flows into the cylinder block 10 in a direction shown by an arrow 101, the coolant flows in the water jacket portion 12, and removes heat of the cylinder liner assembly 11. Then, the coolant flows out through a bypass passage 14. After the coolant flows out through the bypass passage 14, the coolant flows into equipment 200 in FIG. 6, as shown by an arrow 102. The equipment 200 includes an oil cooler, an automatic transmission fluid cooler (ATF cooler), and a turbo cooler. Thus, after the coolant flows out of the cylinder block 10 in the direction shown by the arrow 102, the coolant flows into the equipment 200 including the oil cooler, the ATF cooler, and the turbo cooler.

The cooling structure 1 of a cylinder block according to the second embodiment of the invention includes the cylinder block 10 including the water jacket portion 12 that is provided so as to surround the entire periphery of the bore wall 11*b*; and the water jacket spacer 20 which is inserted in the water jacket portion 12. The water jacket portion 12 is supplied with the coolant 100 W that is the cooling medium, whereby the temperature of the bore wall 11*b* is made uniform. The bypass passage 14 for connecting the water jacket portion 12 to the equipment 200 is provided in the cylinder block 10. A flow rate control mechanism 22 is provided in the vicinity of the bypass passage 14, and reduces the flow rate of the coolant in the space between the water jacket spacer 20 and the bore wall 11*b*.

The flow rate control mechanism 22 is made of a heat insulation material. The flow rate control mechanism 22 reduces the flow rate of the coolant flowing to the bypass passage 14 thorough a concave portion 23 that is provided in the water jacket spacer 20. As shown in FIG. 7, the water jacket spacer 20 includes an upper surface 20*t* and a bottom surface 20*b*. Both of the upper surface 20*t* and the bottom surface 20*b* are in contact with the coolant 100 W. The flow rate control mechanism 22 has a U-shape, and is provided around the concave portion 23. The flow rate control mechanism 22 is provided at the bottom portion of the water jacket portion 12. The flow rate control mechanism 22 is in direct contact with the bore wall 11*b*. The flow rate control mechanism 22 can be made of metal, nonmetal or resin such as foamed rubber and urethane.

In addition to providing the flow rate control mechanism 22, the width of the space between the bore wall 11*b* and the water jacket spacer 20 is made small.

Thus, the flow rate control mechanism 22 reduces the flow rate of the coolant flowing to the bypass passage 14 through the concave portion 23, and also reduces the flow rate of the coolant in the space between the water jacket spacer 20 and the bore wall 11*b*, which is the region upstream of the flow rate control mechanism 22. Accordingly, it is possible to prevent the bore wall 11*b* from being overcooled at this region. As a result, the bore wall 11*b* can be uniformly cooled.

Figure 8:
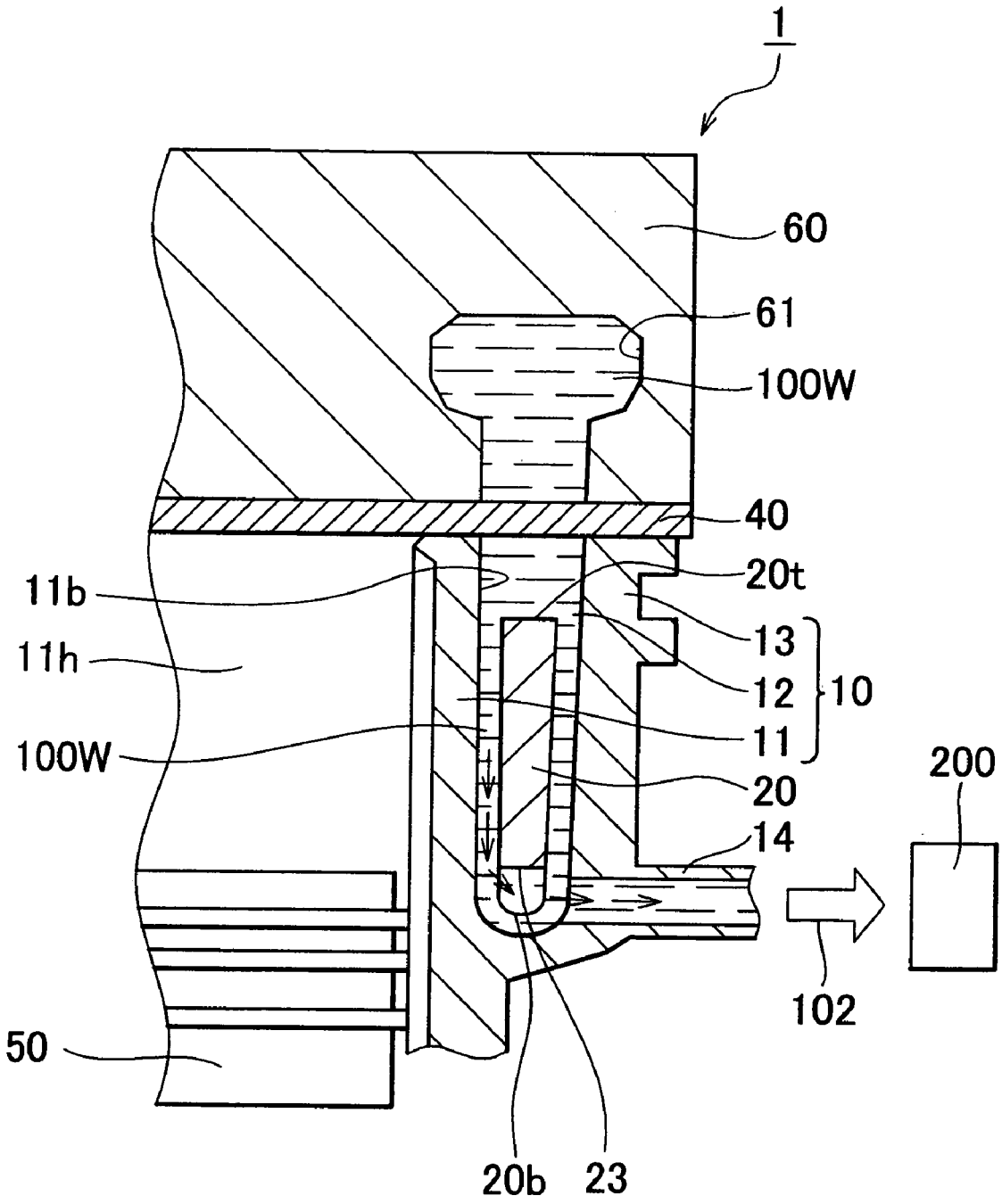
FIG.8 PRIOR ART
FIG. 8 is a cross sectional view showing the cooling structure of a cylinder block according to the comparative example.

FIG. 8 is a cross sectional view showing the cooling structure of a cylinder block according to the comparative example. As shown in FIG. 8, in the cooling structure 1 of a cylinder block according to the comparative example, the flow rate control mechanism 22 is not provided around the concave portion 23. Therefore, a large amount of coolant 100 W flows to the bypass passage 14 through the concave portion 23, as shown by arrows. Thus, the coolant flows in the space between the bore wall 11*b* and the water jacket spacer 20, and the bore wall 11*b* is overcooled.

Figure 9:
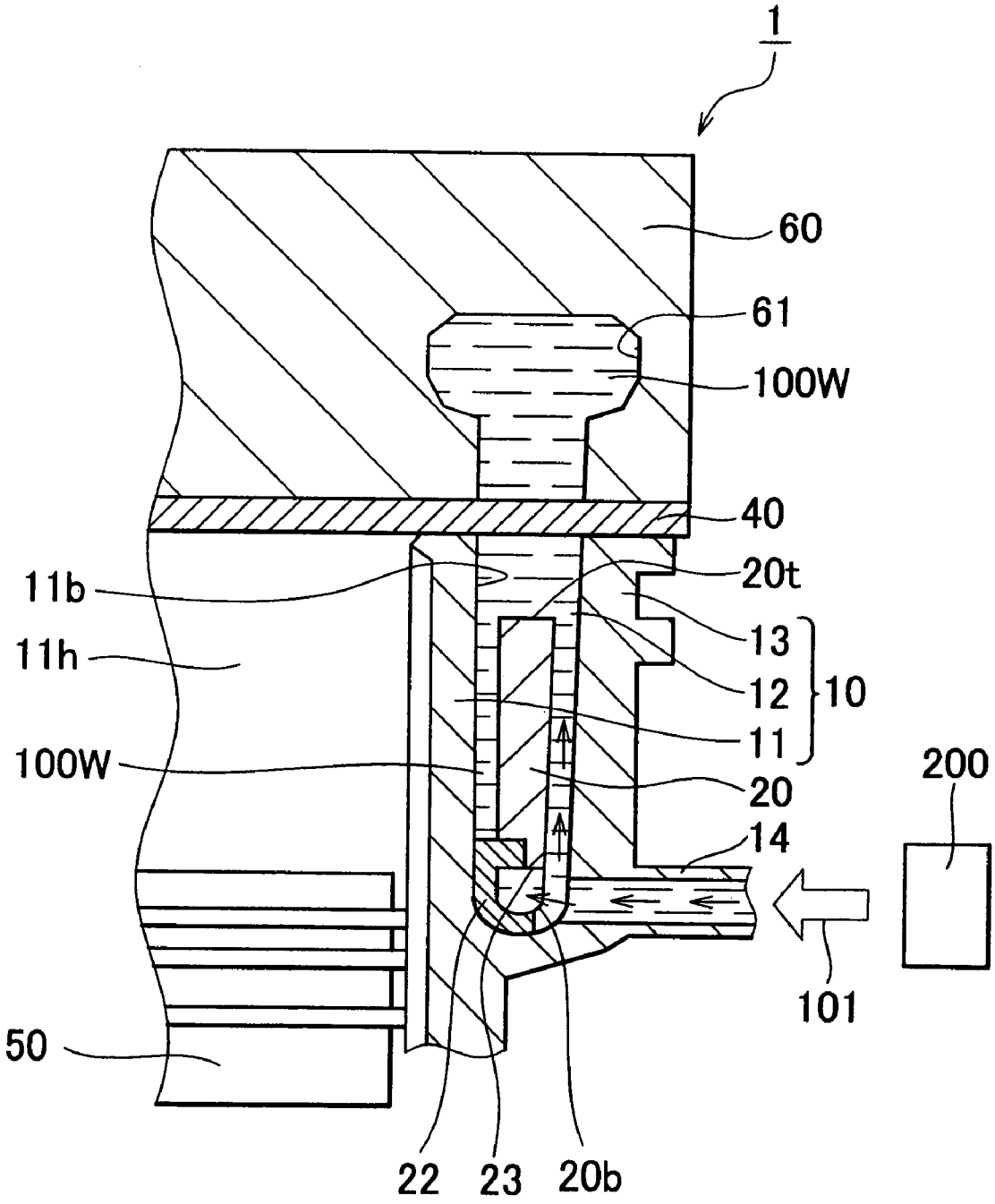
FIG. 9 is a cross sectional view showing a cooling structure of a cylinder block according to a second embodiment of the invention.

FIG. 9 is a cross sectional view showing the cooling structure of a cylinder block according to the second embodiment of the invention. As shown in FIG. 9, even when the coolant is supplied from the equipment 200 through the bypass passage 14 in the direction shown by the arrow 101, since the flow rate control mechanism 22 is provided, it is possible to suppress the flow of the coolant in the space between the bore wall 11*b* and the water jacket spacer 20. Accordingly, the bore wall 11*b* can be prevented from being actively cooled. That is, bore wall 11*b* can be prevented from being overcooled. As a result, the bore wall 11*b* can be uniformly cooled.

Figure 10:
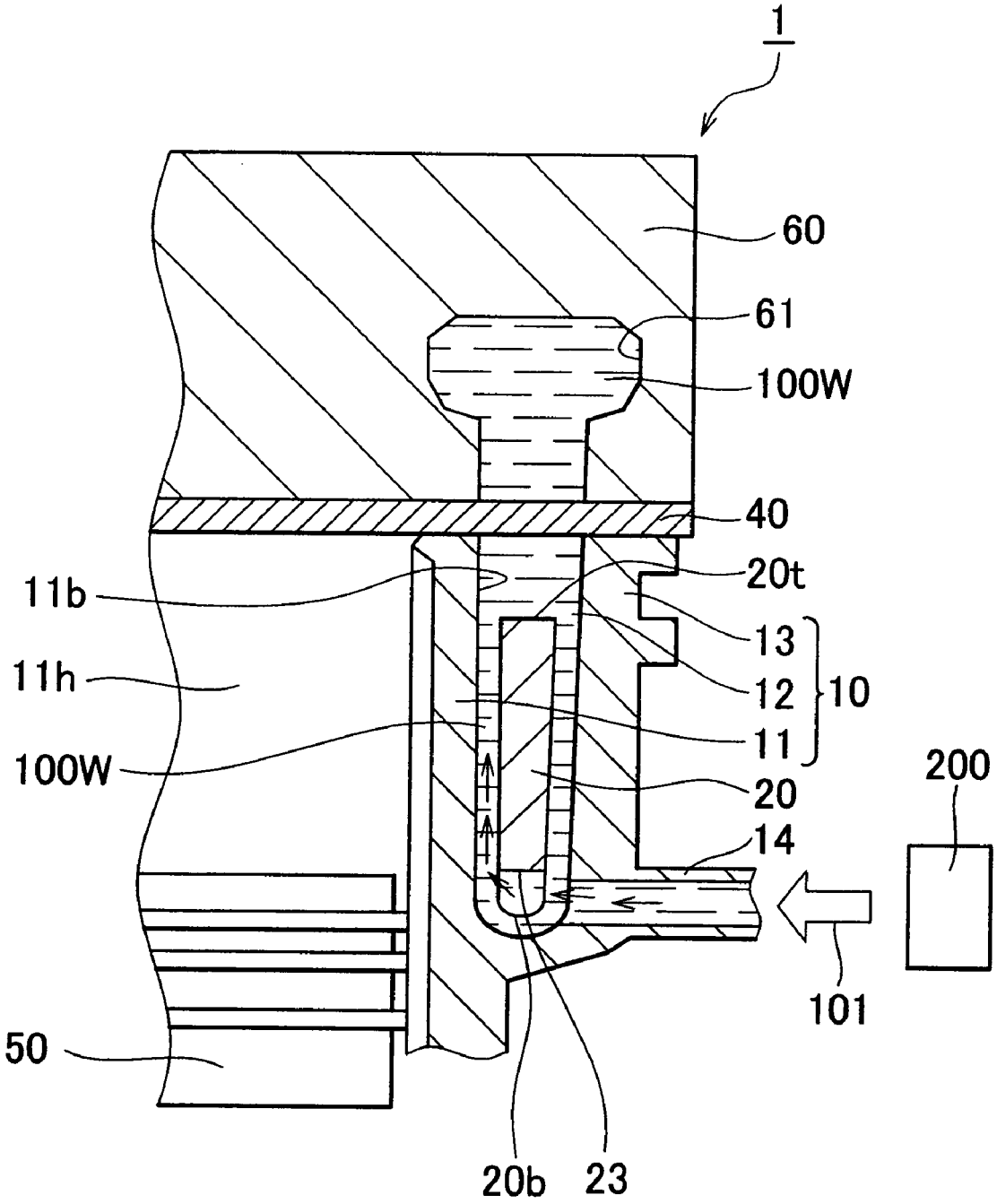
FIG.10 PRIOR ART
FIG. 10 is a cross sectional view showing the cooling structure of a cylinder block according to the comparative example.

FIG. 10 is a cross sectional view showing the cooling structure of a cylinder block according to the comparative example. As shown in FIG. 10, in the comparative example, since the flow rate control mechanism 22 is not provided, a large amount of coolant 100 W flows through the concave portion 23. Since the coolant 100 W flows in the space between the bore wall 11*b* and the water jacket spacer 20, heat of the bore wall 11*b* is removed by the coolant 100 W. As a result, the bore wall 11*b* is overcooled. Meanwhile, according to the second embodiment of the invention, it is possible to reduce the flow rate of the coolant flowing along an inner surface of the bore wall 11*b* in the space between the water jacket spacer 20 and the bore wall 11*b*, by attaching, to the inner surface of the bore wall 11*b*, the flow rate control mechanism 22 that is made of a heat insulation material.

A protrusion portion may be formed in the water jacket spacer 20 in order to suppress the flow of the coolant in the space between the water jacket spacer 20 and the bore wall 11*b*. Also, the width of the space between the water jacket spacer 20 and the bore wall 11*b* is made smaller than the width of the space between the water jacket spacer 20 and the cylinder block base portion 13.

The embodiments of the invention have been described. Various modifications can be made to the aforementioned embodiments. The invention can be applied not only to a gasoline engine, but also to a diesel engine. Also, size of the engine is not limited to specific size, and the number of cylinders is not limited to a specific number. Further, the invention can be applied to various types of engines, such as an in-line engine, a V-type engine, a W-type engine, and a horizontal opposed engine.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A cooling structure for uniformly cooling a bore wall of a cylinder block using a cooling medium, comprising:

a water jacket portion which is provided so as to surround an entire outer periphery of the bore wall, and which is supplied with the cooling medium;

a water jacket spacer which is inserted in the water jacket portion; and a gasket which is provided in an upper portion of the cylinder block, and which includes a hole leading to the water jacket portion, wherein a distance between a center of the hole and an outer periphery of the cylinder block is shorter than a distance between a center of the water jacket spacer in a thickness direction and the outer periphery of the cylinder block.

2. The cooling structure of a cylinder block according to claim 1, wherein a space is formed between the bore wall and the water jacket spacer, the space being supplied with the cooling medium.

3. The cooling structure of a cylinder block according to claim 2, further comprising:

a heat insulation material which is in contact with both of the bore wall and the water jacket spacer, and which suppresses a flow of the cooling medium in the space.

4. A cooling structure for uniformly cooling a bore wall of a cylinder block using a cooling medium, comprising:

a water jacket portion which is provided so as to surround an entire outer periphery of the bore wall and which is supplied with the cooling medium;

a water jacket spacer which is inserted in the water jacket portion;

a bypass passage which is provided in the cylinder block, and which connects the water jacket portion to equipment; and a flow rate control mechanism which is provided in a vicinity of the bypass passage, and which reduces a flow rate of the cooling medium in a space between the water jacket spacer and the bore wall.

5. The cooling structure of a cylinder block according to claim 4, wherein the flow rate control mechanism is made of a heat insulation material.

6. The cooling structure of a cylinder block according to claim 4, wherein the flow rate control mechanism has a U-shape.

* * * * *